US010378814B1

(12) United States Patent
Gaye

(10) Patent No.: US 10,378,814 B1
(45) Date of Patent: Aug. 13, 2019

(54) REFRIGERATOR OR FREEZER ORGANIZATION APPARATUS

(71) Applicant: Ruth Gaye, Raleigh, NC (US)

(72) Inventor: Ruth Gaye, Raleigh, NC (US)

( * ) Notice: Subject to any disclaimer, the term of this patent is extended or adjusted under 35 U.S.C. 154(b) by 0 days.

(21) Appl. No.: 16/030,977

(22) Filed: Jul. 10, 2018

(51) Int. Cl.
*F25D 23/04* (2006.01)
*F25D 11/02* (2006.01)
*F25D 25/02* (2006.01)
*F25D 23/06* (2006.01)

(52) U.S. Cl.
CPC ..... *F25D 23/04* (2013.01); *F25D 11/02* (2013.01); *F25D 23/067* (2013.01); *F25D 25/021* (2013.01); *F25D 25/022* (2013.01); *F25D 25/025* (2013.01)

(58) Field of Classification Search
CPC ..... F25D 11/02; F25D 23/04; F25D 23/067; F25D 25/021; F25D 25/022; F25D 25/025
USPC ..... 312/401, 404, 408
See application file for complete search history.

(56) References Cited

U.S. PATENT DOCUMENTS 3,998,170 A 12/1976 Gordon
4,138,175 A 2/1979 Tattershall
4,283,099 A 8/1981 Burton
D436,754 S 1/2001 Bellini
6,220,465 B1 4/2001 Jones
7,159,415 B2 1/2007 Wood
9,255,729 B2 2/2016 Rindlisbach
9,347,704 B2 5/2016 Ringermann
2011/0259036 A1* 10/2011 Lim ..... F25C 1/24 62/344
2012/0060544 A1* 3/2012 Lee ..... F25D 23/02 62/440
2012/0209763 A1* 8/2012 Zabbatino ..... G06Q 30/0645 705/39
2016/0176568 A1* 6/2016 Glasgow ..... B65D 5/4212 312/404
2017/0122651 A1* 5/2017 Cizik ..... F25D 17/06

FOREIGN PATENT DOCUMENTS

CA 1106896 8/1981

* cited by examiner

*Primary Examiner* — James O Hansen
(74) *Attorney, Agent, or Firm* — Kyle A. Fletcher, Esq.

(57) ABSTRACT

The refrigerator or freezer organization apparatus is an organization apparatus. The refrigerator or freezer organization apparatus is configured for use with a refrigerated device. The refrigerated device comprises one or more chambers. The refrigerator or freezer organization apparatus removably inserts into a chamber selected from the one or more chambers of the refrigerated device. The refrigerator or freezer organization apparatus is a structure that provides sliding storage spaces within the selected chamber. The refrigerator or freezer organization apparatus comprises a shell, a storage structure, and an anchor system. The anchor system and the storage structure attach to the shell. The shell inserts into the selected chamber of the refrigerated device. The anchor system secures the shell to the refrigerated device. The storage chamber presents sliding shelves and baskets that are used for storage within the selected chamber of the refrigerated device.

17 Claims, 6 Drawing Sheets

REFRIGERATOR OR FREEZER ORGANIZATION APPARATUS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of lighting and heating including refrigeration, more specifically, shelves and baskets that support items to be cooled.

SUMMARY OF INVENTION

The refrigerator or freezer organization apparatus is an organization apparatus. The refrigerator or freezer organization apparatus is configured for use with a refrigerated device. The refrigerated device comprises one or more chambers selected from the group consisting of a cold storage chamber, a frozen storage chamber, and a combination of both the cold storage chamber and the frozen storage chamber. The refrigerator or freezer organization apparatus removably inserts into a chamber selected from the one or more chambers of the refrigerated device. The refrigerator or freezer organization apparatus is a structure that provides sliding storage spaces within the selected chamber. The refrigerator or freezer organization apparatus comprises a shell, a storage structure, and an anchor system. The anchor system and the storage structure attach to the shell. The shell inserts into the selected chamber of the refrigerated device. The anchor system secures the shell to the refrigerated device. The storage chamber presents sliding shelves and baskets that are used for storage within the selected chamber of the refrigerated device.

These together with additional objects, features and advantages of the refrigerator or freezer organization apparatus will be readily apparent to those of ordinary skill in the art upon reading the following detailed description of the presently preferred, but nonetheless illustrative, embodiments when taken in conjunction with the accompanying drawings.

In this respect, before explaining the current embodiments of the refrigerator or freezer organization apparatus in detail, it is to be understood that the refrigerator or freezer organization apparatus is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the refrigerator or freezer organization apparatus.

It is therefore important that the claims be regarded as including such equivalent construction insofar as they do not depart from the spirit and scope of the refrigerator or freezer organization apparatus. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
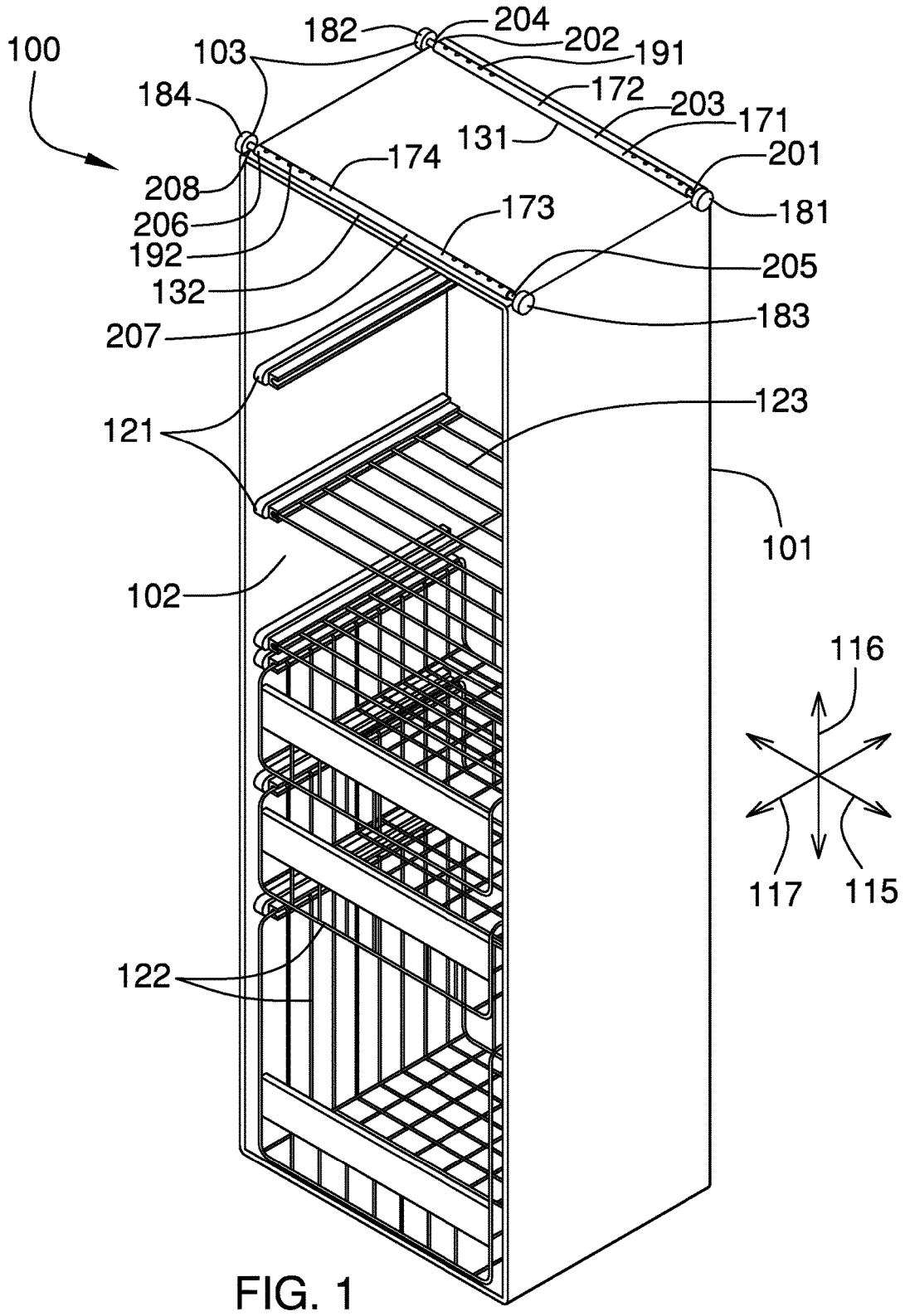
FIG. 1 is a perspective view of an embodiment of the disclosure.
Figure 2:
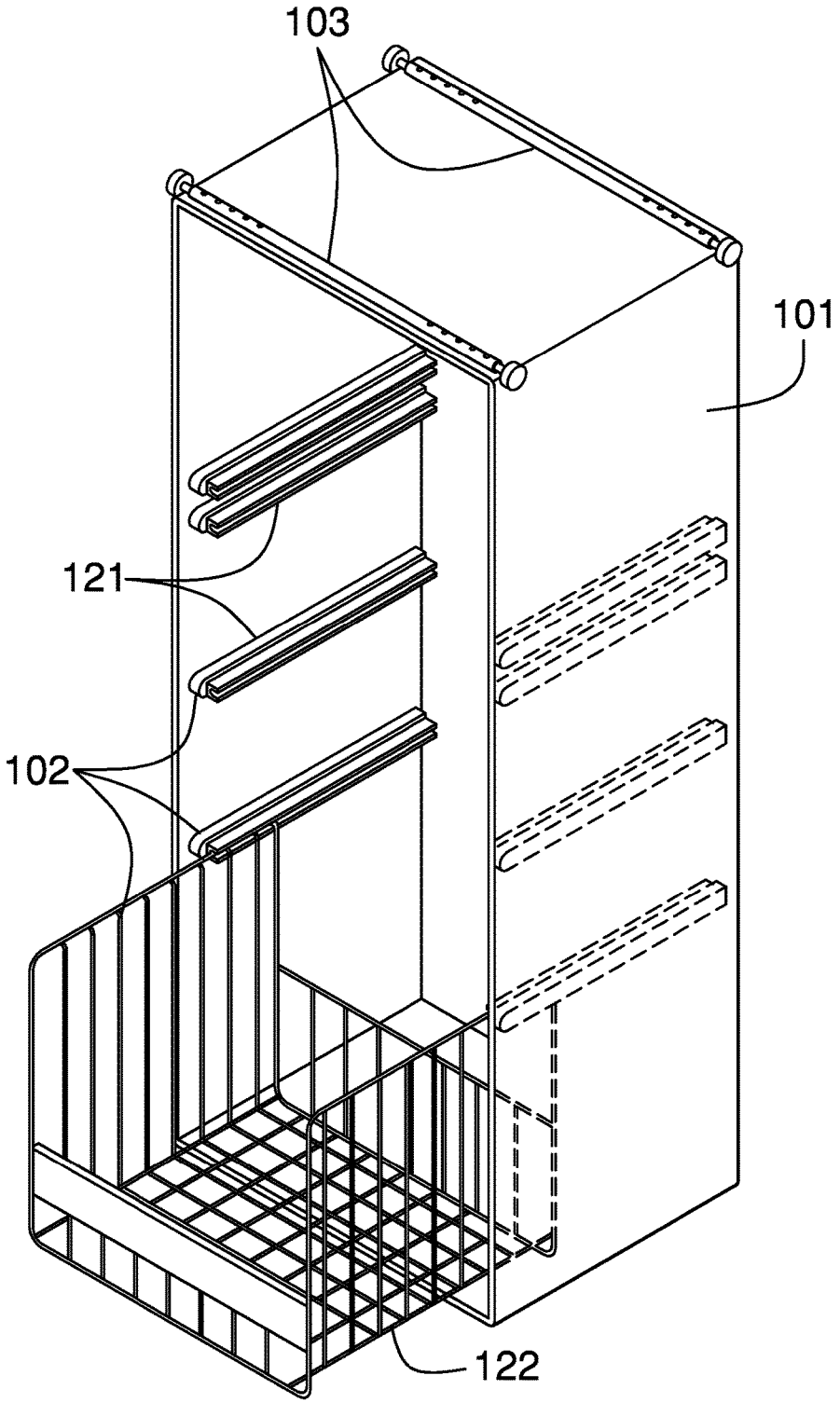
FIG. 2 is a perspective view of an embodiment of the disclosure.
Figure 3:
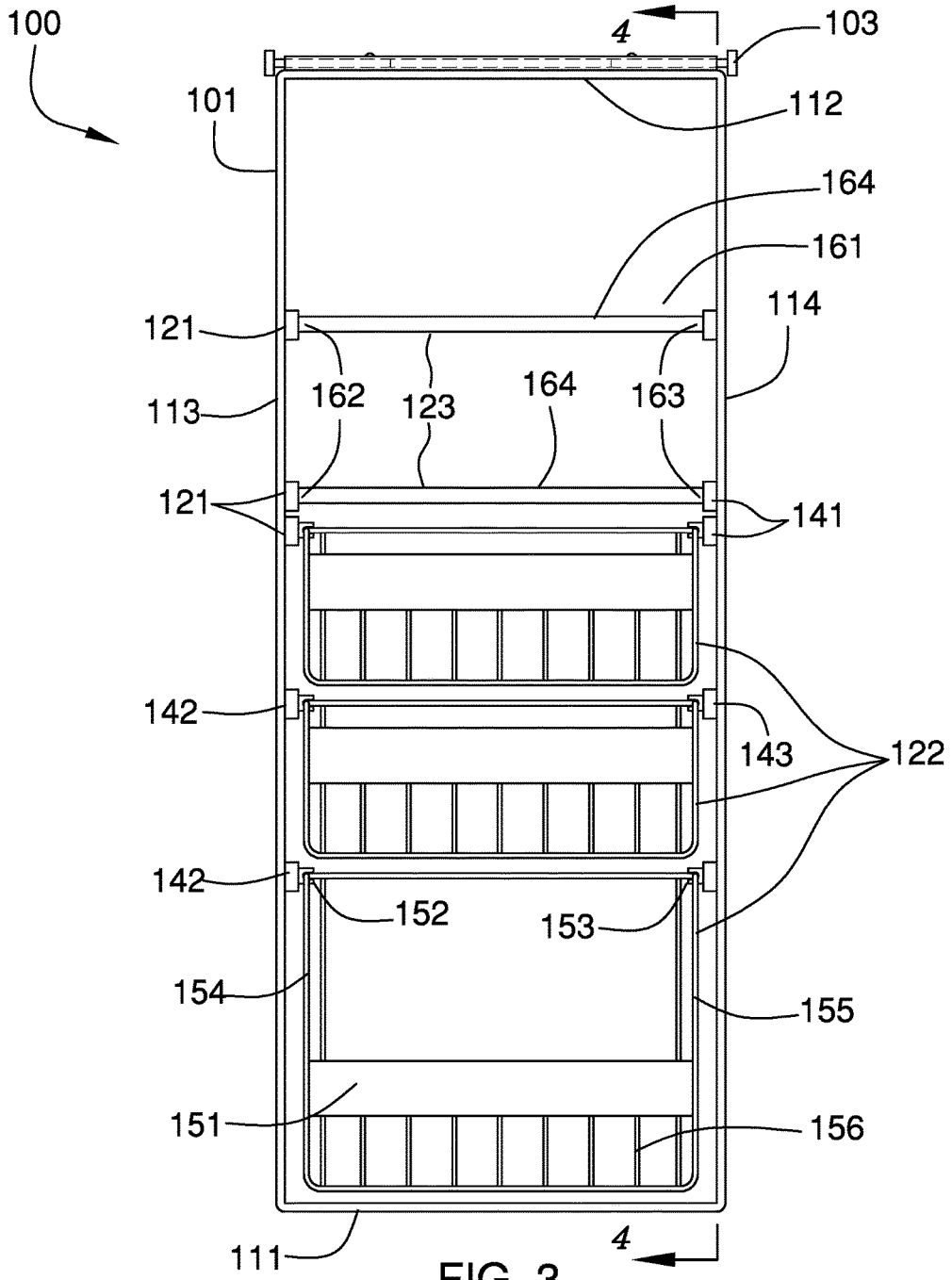
FIG. 3 is a front view of an embodiment of the disclosure.
Figure 4:
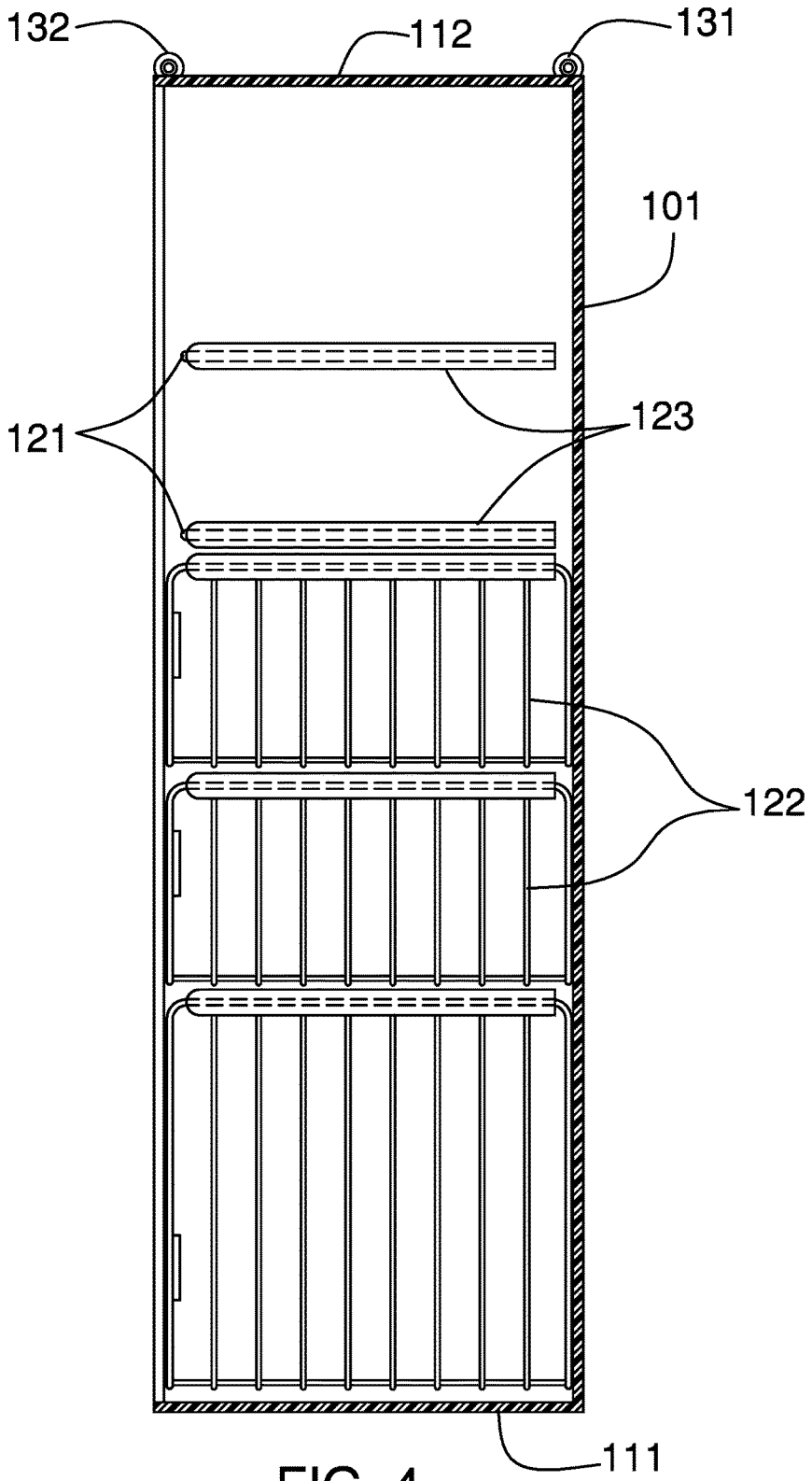
FIG. 4 is a cross-sectional view of an embodiment of the disclosure across 4-4 as shown in FIG. 3.
Figure 5:
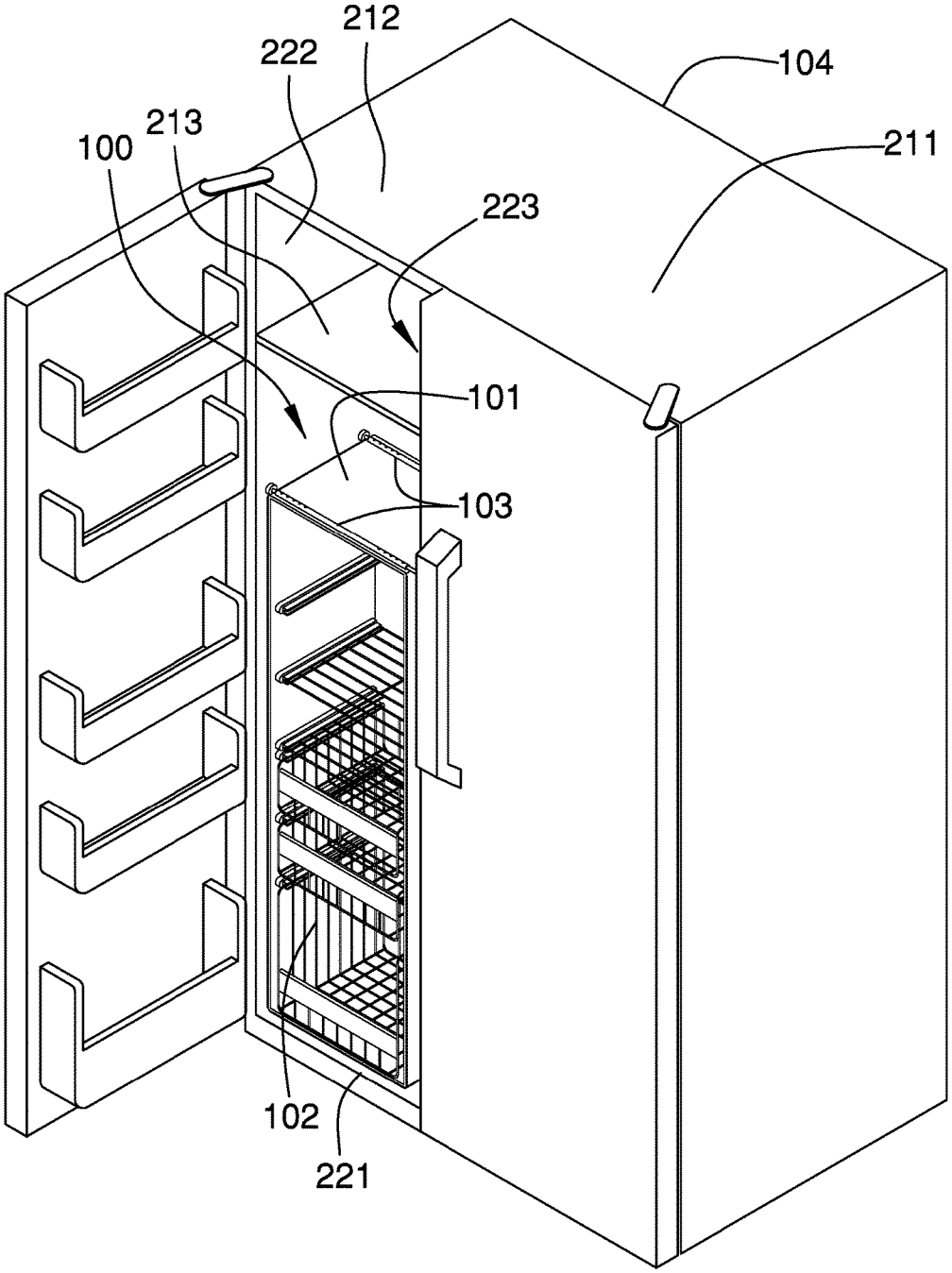
FIG. 5 is an in-use view of an embodiment of the disclosure.
Figure 6:
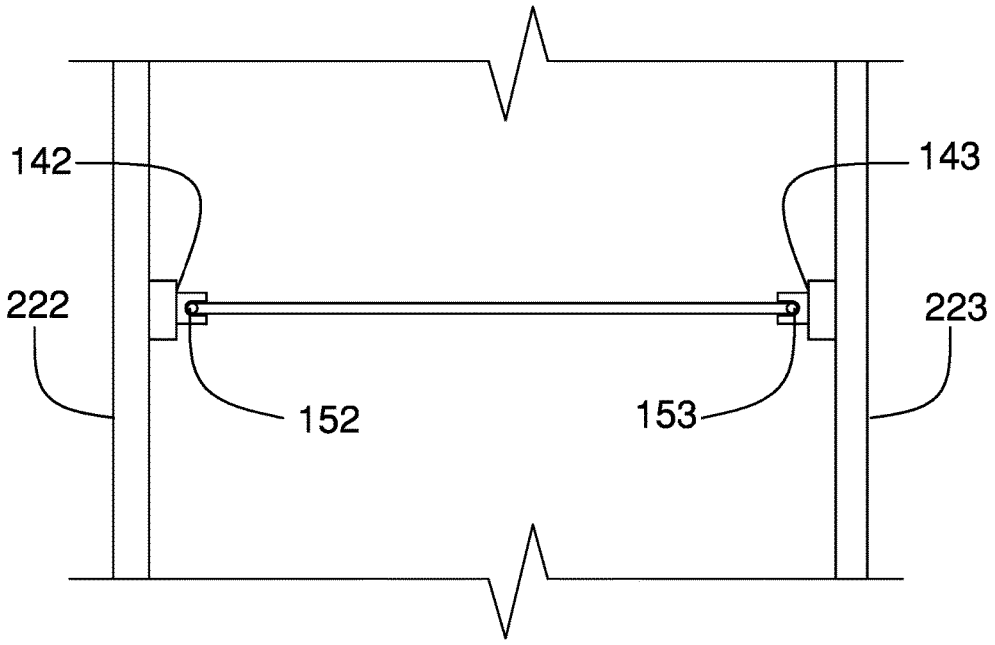
FIG. 6 is a detail view of an embodiment of the disclosure.
Figure 7:
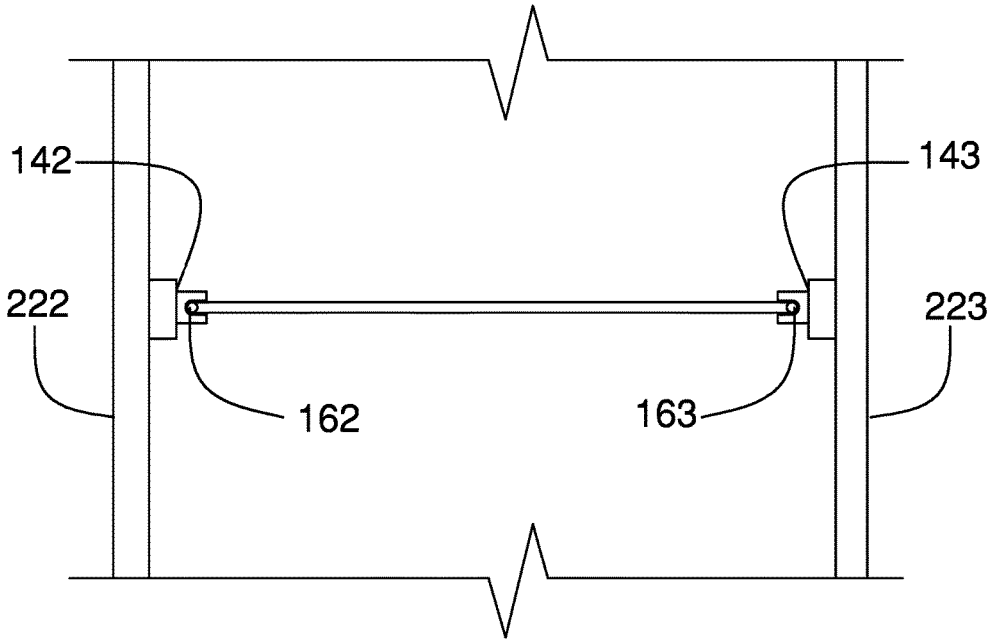
FIG. 7 is a detail view of an embodiment of the disclosure.

Detailed reference will now be made to one or more potential embodiments of the disclosure, which are illustrated in FIGS. 1 through 7.

The refrigerator or freezer organization apparatus 100 (hereinafter invention) is an organization structure. The invention 100 is configured for use with a refrigerated device 104. The refrigerated device 104 comprises one or more chambers selected from the group consisting of a cold storage chamber 211, a frozen storage chamber 212, and a combination of both the cold storage chamber 211 and the frozen storage chamber 212. The invention 100 removably inserts into a chamber selected 213 from the one or more chambers of the refrigerated device 104. The invention 100 is a structure that provides sliding storage spaces within the selected chamber 213. The invention 100 comprises a shell 101, a storage structure 102, and an anchor system 103. The anchor system 103 and the storage structure 102 attach to the shell 101. The shell 101 inserts into the selected chamber 213 of the refrigerated device 104. The anchor system 103 secures the shell 101 to the refrigerated device 104. The storage chamber presents sliding shelves and baskets that are used for storage within the selected chamber 213 of the refrigerated device 104.

The refrigerated device 104 is an appliance. The cold storage chamber 211 is a chamber of the refrigerated device 104 that stores objects at a controlled temperature of approximately 0 degrees Fahrenheit. The frozen storage chamber 212 is a chamber of the refrigerated device 104 that stores objects at a controlled temperature of approximately 35 degrees Fahrenheit. The selected chamber 213 is further defined with an inferior horizontal surface 221, a left vertical surface 222, and a right vertical surface 223. In the first potential embodiment of the disclosure assumes that the refrigerated device 104 is a side by side refrigerator.

The shell 101 is a framework. The shell 101 rests on the inferior horizontal surface 221 of the selected chamber 213 of the refrigerated device 104. The inferior horizontal surface 221 forms the supporting surface of the shell 101. The shell 101 is secured to the left vertical surface 222 and the right vertical surface 223 of the refrigerated device 104 by the anchor system 103. The shell 101 has a hollow rectangular block shape. The outer dimensions of the shell 101 are lesser than the inner dimensions of the selected chamber 213 such that the shell 101 inserts into the selected chamber 213. The shell 101 comprises a floor 111, a roof 112, a left wall 113, and a right wall 114. The shell 101 is further defined with a width 115, a height 116, and a depth 117.

The floor 111 is a rectangular plate structure that forms the inferior face of the shell 101. The floor 111 rests on the inferior horizontal surface 221 of the selected chamber 213 when the shell 101 installs in the selected chamber 213. The roof 112 is a rectangular plate structure that forms the superior face of the shell 101. The roof 112 is distal from the floor 111.

The left wall 113 is a rectangular plate structure that forms a vertical face of the shell 101. The left wall 113 is placed against the left vertical surface 222 of the selected chamber 213 when the shell 101 installs in the selected chamber 213. The right wall 114 is a rectangular plate structure that forms a vertical face of the shell 101. The right wall 114 is placed against the right vertical surface 223 of the selected chamber 213 when the shell 101 installs in the selected chamber 213. The right wall 114 is distal from the left wall 113. The right wall 114 is identical to the left wall 113.

The width 115 is the span of the perpendicular distance between the left wall 113 and the right wall 114 of the shell 101. The height 116 is the span of the perpendicular distance between the floor 111 and the roof 112 of the shell 101. The depth 117 is the span of the perpendicular distance between the longest edge of the right wall 114 and the second longest edge of the right wall 114. The directions of the width 115, the height 116, and the depth 117 are perpendicular to each other. In this disclosure, the width 115, the height 116, and the depth 117 are further used as directional references for both the invention 100 and the selected chamber 213.

The storage structure 102 is a rack system. The storage structure 102 is installed in the hollow interior of the shell 101. The storage structure 102 comprises a collection of sliding shelves and baskets used to store items within the selected chamber 213 of the refrigerated device 104. The storage structure 102 comprises a plurality of tracks 121, a plurality of baskets 122, and a plurality of shelves 123.

Each of the plurality of tracks 121 is a track structure that supports a storage device selected from the group consisting of a basket selected from the plurality of baskets 122 and a shelf selected from the plurality of shelves 123. Each of the plurality of tracks 121 attach the selected storage device to the left wall 113 and the right wall 114 of the shell 101. The plurality of tracks 121 comprises a collection of individual tracks 141. Each individual track 141 comprises a left channel 142, and a right channel 143.

Each of the plurality of baskets 122 forms a storage container used to support objects above the floor 111 of the shell 101. Each of the plurality of baskets 122 is a hollow structure formed with four vertical surfaces, an inferior horizontal surface, and an open superior face. In the first potential embodiment of the disclosure, each of the plurality of baskets 122 is an openwork structure. The plurality of baskets 122 comprises a collection of individual baskets 151. Each individual basket 151 comprises a left rail 152, a right rail 153, a left arm 154, a right arm 155, and a container 156.

The plurality of shelves 123 forms a horizontal supporting surface 164 used to support objects above the floor 111 of the shell 101. The plurality of shelves 123 forms a flat or plate-like structure. In the first potential embodiment of the disclosure, the plurality of shelves 123 is an openwork structure. The plurality of shelves 123 comprises a collection of individual shelves 161. Each individual shelf 161 comprises a left edge 162, a right edge 163, and a horizontal supporting surface 164.

The individual track 141 forms a track that guides a storage device selected from the group consisting of a basket selected from the plurality of baskets 122 and a shelf selected from the plurality of shelves 123. The individual track 141 receives the selected storage device such that the selected storage device is raised above the floor 111 of the shell 101. The individual track 141 receives the selected storage device such that the selected storage device slides along the depth 117 direction of the shell 101. The individual track 141 attaches to the left wall 113 and the right wall 114 of the shell 101.

The left channel 142 is a hyoid shape structure that attaches to the left wall 113 of the shell 101 such that the arms of the hyoid are parallel to the floor 111 of the shell 101. The left channel 142 is sized to receive an attachment member associated with the storage device selected from the group consisting of a basket selected from the plurality of baskets 122 and a shelf selected from the plurality of shelves 123. In the first potential embodiment of the disclosure, the attachment element received by the left channel 142 is selected from the group consisting of a rail or an edge.

The right channel 143 is a hyoid shape structure that attaches to the right wall 114 of the shell 101 such that the arms of the hyoid are parallel to the floor 111 of the shell 101. The right channel 143 is sized to receive an attachment member associated with the storage device selected from the group consisting of a basket selected from the plurality of baskets 122 and a shelf selected from the plurality of shelves 123. In the first potential embodiment of the disclosure, the attachment element received by the right channel 143 is selected from the group consisting of a rail or an edge.

The individual basket 151 is a basket selected from the plurality of baskets 122. Each individual basket 151 selected from the plurality of baskets 122 has a similar construction that varies only in the height 116 of the individual basket 151.

The left rail 152 attaches the individual basket 151 to the left channel 142 of the individual track 141 identified to support the individual basket 151. As shown most clearly in FIG. 6, the left rail 152 is a cylindrical shaft structure that installs into the left channel 142 such that the left rail 152 will slide along the depth 117 direction when installed in the left channel 142. The right rail 153 attaches the individual basket 151 to the right channel 143 of the individual track 141 identified to support the individual basket 151. The right rail 153 is a cylindrical shaft structure that installs into the right channel 143 such that the right rail 153 will slide in the depth 117 direction when installed in the right channel 143.

The left arm 154 is a mechanical structure that attaches the left rail 152 to the container 156 such that the left rail 152 will slide within the left channel 142. The right arm 155 is a mechanical structure that attaches the right rail 153 to the container 156 such that the right rail 153 will slide within the right channel 143.

The container 156 is a hollow rectangular block structure formed with four vertical surfaces, an inferior horizontal surface, and an open superior face. The container 156 stores items within the selected chamber 213.

The individual shelf 161 is a shelf selected from the plurality of shelves 123. Each individual shelf 161 selected from the plurality of shelves 123 are identical. The left edge 162 attaches the individual shelf 161 to the left channel 142 of the individual track 141 identified to support the individual shelf 161. As shown most clearly in FIG. 7, the left edge 162 is a cylindrical shaft structure that installs into the left channel 142 such that the left edge 162 will slide along the depth 117 direction when installed in the left channel 142. The right edge 163 attaches the individual shelf 161 to the right channel 143 of the individual track 141 identified to support the individual shelf 161. The right edge 163 is a cylindrical shaft structure that installs into the right channel 143 such that the right edge 163 will slide in the depth 117 direction when installed in the right channel 143. The horizontal supporting surface 164 forms a flat horizontal surface that stores items within the selected chamber 213.

The anchor system 103 is a friction based device. The anchor system 103 attaches to the superior side of the roof 112 of the shell 101. The anchor system 103 is a telescopic device. The anchor system 103 is set up such that the anchor system 103 applies pressure to the left vertical surface 222 and the right vertical surface 223 of the selected chamber 213. The pressure applied by the anchor system 103 to the left vertical surface 222 and the right vertical surface 223 creates a frictional force that prevents the shell 101 from shifting within the selected chamber 213 of the refrigerated device 104. The anchor system 103 comprises a first telescopic anchor 131 and a second telescopic anchor 132.

The first telescopic anchor 131 is a telescopic structure. The first telescopic anchor 131 attaches to the superior surface of the roof 112 of the shell 101. The first telescopic anchor 131 is formed as a composite prism. The first telescopic anchor 131 secures the shell 101 to the left vertical surface 222 and the right vertical surface 223 of the selected chamber 213. The second telescopic anchor 132 is a telescopic structure. The second telescopic anchor 132 attaches to the superior surface of the roof 112 of the shell 101. The second telescopic anchor 132 is formed as a composite prism. The second telescopic anchor 132 secures the shell 101 to the left vertical surface 222 and the right vertical surface 223 of the selected chamber 213. The first telescopic anchor 131 and the second telescopic anchor 132 have identical constructions.

The first telescopic anchor 131 further comprises a first arm 171, a second arm 172 and a first detent 191. The first detent 191 connects the second arm 172 to the first arm 171. The first arm 171 is a hollow first prism that is further defined with an inner dimension. The second arm 172 is a second prism that is further defined with an outer dimension. The first arm 171 and the second arm 172 are geometrically similar. The outer dimension of the second arm 172 is less than the inner dimension of the first arm 171 such that the second arm 172 can be inserted into the first arm 171 in a telescopic manner. This telescopic arrangement of the first telescopic anchor 131 allows the length of the first telescopic anchor 131 to be adjusted by adjusting the relative position of the second arm 172 within the first arm 171. The position of the second arm 172 relative to the first arm 171 is held in position using the first detent 191. The first detent 191 is a mechanical device that connects and secures the first arm 171 to the second arm 172.

The second telescopic anchor 132 further comprises a third arm 173, a fourth arm 174 and a second detent 192. The second detent 192 connects the fourth arm 174 to the third arm 173. The third arm 173 is a hollow first prism that is further defined with an inner dimension. The fourth arm 174 is a second prism that is further defined with an outer dimension. The third arm 173 and the fourth arm 174 are geometrically similar. The outer dimension of the fourth arm 174 is less than the inner dimension of the third arm 173 such that the fourth arm 174 can be inserted into the third arm 173 in a telescopic manner. This telescopic arrangement of the second telescopic anchor 132 allows the length of the second telescopic anchor 132 to be adjusted by adjusting the relative position of the fourth arm 174 within the third arm 173. The position of the fourth arm 174 relative to the third arm 173 is held in position using the second detent 192. The second detent 192 is a mechanical device that connects and secures the third arm 173 to the fourth arm 174.

The span of the length of the combination of the first arm 171 and the second arm 172 is selected such that the first telescopic anchor 131 will fit tightly between the left vertical surface 222 and the right vertical surface 223. The tight fight of the first telescopic anchor 131 creates frictional forces between the first telescopic anchor 131 and the selected chamber 213 that prevents the shell 101 from shifting within the selected chamber 213. The span of the length of the combination of the third arm 173 and the fourth arm 174 is selected such that the second telescopic anchor 132 will fit tightly between the left vertical surface 222 and the right vertical surface 223. The tight fight of the second telescopic anchor 132 creates frictional forces between the second telescopic anchor 132 and the selected chamber 213 that prevents the shell 101 from shifting within the selected chamber 213.

The first arm 171 is further defined with a first end 201 and a second end 202. The second arm 172 is further defined with a third end 203 and a fourth end 204. The third arm 173 is further defined with a fifth end 205 and a sixth end 206. The fourth arm 174 is further defined with a seventh end 207 and an eighth end 208. The third end 203 of the second arm 172 inserts into the second end 202 of the first arm 171. The seventh end 207 of the fourth arm 174 inserts into the sixth end 206 of the second arm 172.

The first arm 171 further comprises a first pad 181. The second arm 172 further comprises a second pad 182. The third arm 173 further comprises a third pad 183. The fourth arm 174 further comprises a fourth pad 184. The first pad 181 is a leg tip for a chair. The first pad 181 forms a non-skid surface that attaches to the first end 201 of the first arm 171. The second pad 182 is a leg tip for a chair. The second pad 182 forms a non-skid surface that attaches to the fourth end 204 of the second arm 172. The third pad 183 is a leg tip for a chair. The third pad 183 forms a non-skid surface that attaches to the fifth end 205 of the third arm 173. The fourth pad 184 is a leg tip for a chair. The fourth pad 184 forms a non-skid surface that attaches to the eighth end 208 of the fourth arm 174.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Anchor: As used in this disclosure, anchor means to hold an object firmly or securely.

Appliance: As used in this disclosure, an appliance is an externally powered device or instrument intended for household use.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Chamber: As used in this disclosure, a chamber is an enclosed or enclosable space that is dedicated to a purpose.

Channel: As used in this disclosure, a channel is a tubular passage through which an object or fluid is passed through.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Correspond: As used in this disclosure, the term correspond is used as a comparison between two or more objects wherein one or more properties shared by the two or more objects match, agree, or align within acceptable manufacturing tolerances.

Floor: As used in this disclosure a floor refers to either: 1) the inferior horizontal surface of a room upon which one stands; 2) the inferior horizontal surface of a structure; 3) a bottom or base; or, 4) the lower limit of a range. The selection of the definition depends on the context. In situations where the context is unclear the third definition should be used.

Framework: As used in this disclosure, a framework refers to the substructure of an object that carries the load path of the object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Hyoid: As used in this disclosure, a hyoid refers to a three sided structure comprising a crossbeam, a first arm, and a second arm. In a hyoid, the first arm and the second arm project away from the crossbeam: 1) in the same direction; 2) at a roughly perpendicular angle to the crossbeam, and, 3) the span of length of the first arm roughly equals the span of length of the second arm. Hyoids generally have a U shaped appearance.

Inferior: As used in this disclosure, the term inferior refers to a directional reference that is parallel to and in the same direction as the force of gravity when an object is positioned or used normally.

Inner Dimension: As used in this disclosure, the term inner dimension describes the span from a first inside or interior surface of a container to a second inside or interior surface of a container. The term is used in much the same way that a plumber would refer to the inner diameter of a pipe.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

N-gon: As used in this disclosure, an N-gon is a regular polygon with N sides wherein N is a positive integer number greater than 2.

One to One: When used in this disclosure, a one to one relationship means that a first element selected from a first set is in some manner connected to only one element of a second set. A one to one correspondence means that the one to one relationship exists both from the first set the second set and from the second set to the first set. A one to one fashion means that the one to one relationship exists in only one direction.

Openwork: As used in this disclosure, the term open work is used to describe a structure, often a surface, which is formed with openings that allow for visibility and airflow through the structure. Wrought work and meshes are forms of openwork.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Pad: As used in this disclosure, a pad is a mass of soft material used as a filling or for protection against damage or injury. Commonly used padding materials include, but are not limited to, polyurethane foam, silicone, a polyester fill often referred to as fiberfill or polystyrene beads often referred to as stuffing beans or as bean bag chair beans.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Pyramid: As used in this disclosure, a pyramid is a three-dimensional shape that comprises a base formed in the shape of an N-gon (wherein N is an integer) with N triangular faces that rise from the base to converge at a point above the base. If the point where the N faces meet is positioned such that a line drawn from the point where the N faces meet to the center of the N-gon base is perpendicular to the N-gon base, the pyramid is referred to as a right pyramid. Pyramids can be further formed with circular or elliptical bases which are commonly referred to as cone or an elliptical pyramid respectively. A pyramid is defined with a base, an apex, and a lateral face. The base is the N-gon shaped base described above. The apex is the convergence point described above. The lateral face is formed from the N triangular faces described above.

Rail: As used in this disclosure, a rail is a generic term that refers to a structure with a primary sense of direction that is perpendicular to the direction of the gravitational force.

Roof: As used in this disclosure, a roof is the surface of a chamber that is distal from the floor. The roof is typically the superior surface of the chamber.

Shell: As used in this disclosure, a shell is a structure that forms an outer covering intended to contain an object. Shells are often, but not necessarily, rigid or semi-rigid structures that are intended to protect the object contained within it.

Slide: As used in this disclosure, slide is a verb that refers to an object that is transported along a surface while in continuous contact with the surface. An object being transported along a surface with wheels cannot be said to be sliding.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load path of the object is transferred. This disclosure assumes that an object placed on the supporting surface is in an orientation that is appropriate for the normal or anticipated use of the object.

Telescopic: As used in this disclosure, telescopic is an adjective that describes an object made of sections that fit or slide into each other such that the object can be made longer or shorter by adjusting the relative positions of the sections.

Track: As used in this disclosure, a track is a structural relationship between a first object and a second object that serves a purpose selected from the group consisting of: 1) fastening the second object to the first object; 2) controlling the path of motion of the first object relative to the second object in at least one dimension and in a maximum of two dimensions; or, 3) a combination of the first two elements of this group.

Truncated: As used in this disclosure, a geometric object is truncated when an apex, vertex, or end is cut off by a line or plane.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Wall: As used in this disclosure, a wall is a vertical surface of a chamber.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An organizing apparatus comprising:

a shell, a storage structure, and an anchor system;

wherein the anchor system and the storage structure attach to the shell;

wherein the organizing apparatus is configured for use with a refrigerated device;

wherein the refrigerated device comprises one or more chambers selected from the group consisting of a cold storage chamber and a frozen storage chamber;

wherein the selected chamber is further defined with an inferior horizontal surface, a left vertical surface, and a right vertical surface;

wherein the organizing apparatus removably inserts into a chamber selected from the one or more chambers of the refrigerated device;

wherein the shell inserts into the selected chamber of the refrigerated device;

wherein the anchor system secures the shell to the refrigerated device;

wherein the storage structure presents sliding shelves and baskets that are used for storage within the selected chamber of the refrigerated device;

wherein the shell is a framework;

wherein the inferior horizontal surface forms the supporting surface of the shell;

wherein the shell is secured to the left vertical surface and the right vertical surface of the refrigerated device by the anchor system;

wherein the shell has a hollow rectangular block shape;

wherein the outer dimensions of the shell are lesser than the inner dimensions of the selected chamber such that the shell inserts into the selected chamber;

wherein the storage structure installs in the hollow interior of the shell;

wherein the shell comprises a floor, a roof, a left wall, and a right wall;

wherein the shell is further defined with a width, a height, and a depth;

wherein the floor is a rectangular plate structure that forms the inferior face of the shell;

wherein the roof is a rectangular plate structure that forms the superior face of the shell;

wherein the left wall is a rectangular plate structure that forms a vertical face of the shell;

wherein the right wall is a rectangular plate structure that forms a vertical face of the shell;

wherein the floor rests on the inferior horizontal surface of the selected chamber when the shell installs in the selected chamber;

wherein the left wall is placed against the left vertical surface of the selected chamber when the shell installs in the selected chamber;

wherein the right wall is placed against the right vertical surface of the selected chamber when the shell installs in the selected chamber;

wherein the width is the span of the perpendicular distance between the left wall and the right wall of the shell;

wherein the height is the span of the perpendicular distance between the floor and the roof of the shell;

wherein the depth is the span of the perpendicular distance between the longest edge of the right wall and the second longest edge of the right wall;

wherein the directions of the width, the height, and the depth are perpendicular to each other;

wherein the width, the height, and the depth are further used as directional references for both the organizing apparatus and the selected chamber.

2. The organizing apparatus according to claim 1 wherein the anchor system is a friction based device;

wherein the anchor system attaches to the superior side of the roof of the shell;

wherein the anchor system is a telescopic device;

wherein the anchor system applies pressure to the left vertical surface and the right vertical surface of the selected chamber.

3. The organizing apparatus according to claim 2 wherein the storage structure comprises a plurality of tracks, a plurality of baskets, and a plurality of shelves;

wherein each of the plurality of tracks is a track structure that supports a storage device selected from the group consisting of a basket selected from the plurality of baskets and a shelf selected from the plurality of shelves;

wherein each of the plurality of tracks attach the selected storage device to the left wall and the right wall of the shell.

4. The organizing apparatus according to claim 3 wherein each of the plurality of baskets forms a storage container;

wherein each of the plurality of baskets is a hollow structure formed with four vertical surfaces, an inferior horizontal surface, and an open superior face;

wherein the plurality of shelves forms a horizontal supporting;

wherein the plurality of shelves forms a flat or plate-like structure.

5. The organizing apparatus according to claim 4 wherein the plurality of tracks comprises a collection of individual tracks;

wherein each individual track comprises a left channel and a right channel;

wherein the left channel attaches to the left wall;

wherein the right channel attaches to the right wall;

wherein the individual track forms a track that guides a storage device selected from the group consisting of a basket selected from the plurality of baskets and a shelf selected from the plurality of shelves;

wherein the individual track receives the selected storage device such that the selected storage device is raised above the floor of the shell;

wherein the individual track receives the selected storage device such that the selected storage device slides along the depth direction of the shell.

6. The organizing apparatus according to claim 5 wherein the plurality of baskets comprises a collection of individual baskets;

wherein each individual basket comprises a left rail, a right rail, a left arm, a right arm, and a container;

wherein the left arm attaches the left rail to the container;

wherein the right arm attaches the right rail to the container;

wherein the plurality of shelves comprises a collection of individual shelves;

wherein each individual shelf comprises a left edge, a right edge, and a horizontal supporting surface.

7. The organizing apparatus according to claim 6 wherein the left channel is a hyoid shape structure that attaches to the left wall of the shell such that the arms of the hyoid are parallel to the floor of the shell;

wherein the right channel is a hyoid shape structure that attaches to the right wall of the shell such that the arms of the hyoid are parallel to the floor of the shell.

8. The organizing apparatus according to claim 7 wherein the left channel is sized to receive an attachment member associated with the storage device selected from the group consisting of a basket selected from the plurality of baskets and a shelf selected from the plurality of shelves;

wherein the right channel is sized to receive an attachment member associated with the storage device selected from the group consisting of a basket selected from the plurality of baskets and a shelf selected from the plurality of shelves.

9. The organizing apparatus according to claim 8 wherein the attachment element received by the left channel is selected from the group consisting of a rail or an edge;

wherein the attachment element received by the right channel is selected from the group consisting of a rail or an edge.

10. The organizing apparatus according to claim 9 wherein the left rail attaches the individual basket to the left channel of the individual track identified to support the individual basket;

wherein the right rail attaches the individual basket to the right channel of the individual track identified to support the individual basket;

wherein the left rail is a cylindrical shaft structure that installs into the left channel such that the left rail will slide along the depth direction when installed in the left channel;

wherein the right rail is a cylindrical shaft structure that installs into the right channel such that the right rail will slide in the depth direction when installed in the right channel.

11. The organizing apparatus according to claim 10 wherein the left arm is a mechanical structure that attaches the left rail to the container such that the left rail will slide within the left channel;

wherein the right arm is a mechanical structure that attaches the right rail to the container such that the right rail will slide within the right channel;

wherein the container is a hollow rectangular block structure formed with the four vertical surfaces, the inferior horizontal surface, and the open superior face.

12. The organizing apparatus according to claim 11 wherein the left edge attaches the individual shelf to the left channel of the individual track identified to support the individual shelf;

wherein the right edge attaches the individual shelf to the right channel of the individual track identified to support the individual shelf;

wherein the left edge is a cylindrical shaft structure that installs into the left channel such that the left edge will slide along the depth direction when installed in the left channel;

wherein the right edge is a cylindrical shaft structure that installs into the right channel such that the right edge will slide in the depth direction when installed in the right channel;

wherein the horizontal supporting surface forms a flat horizontal surface that stores items within the selected chamber.

13. The organizing apparatus according to claim 12 wherein each individual shelf selected from the plurality of shelves are identical.

14. The organizing apparatus according to claim 13 wherein the anchor system comprises a first telescopic anchor and a second telescopic anchor;

wherein the first telescopic anchor is a telescopic structure;

wherein the second telescopic anchor is a telescopic structure;

wherein the first telescopic anchor attaches to the superior surface of the roof of the shell;

wherein the second telescopic anchor attaches to the superior surface of the roof of the shell;

wherein the first telescopic anchor is formed as a composite prism;

wherein the second telescopic anchor is formed as a composite prism;

wherein the first telescopic anchor secures the shell to the left vertical surface and the right vertical surface of the selected chamber;

wherein the second telescopic anchor secures the shell to the left vertical surface and the right vertical surface of the selected chamber;

wherein the first telescopic anchor and the second telescopic anchor have identical constructions.

15. The organizing apparatus according to claim 14 wherein the first telescopic anchor further comprises a first arm, a second arm, and a first detent;

wherein the second telescopic anchor further comprises a third arm, a fourth arm, and a second detent;

wherein the first detent is a mechanical device that connects and secures the first arm to the second arm;

wherein the second detent is a mechanical device that connects and secures the third arm to the fourth arm;

wherein the first arm is a hollow first prism that is further defined with a first inner dimension;

wherein the second arm is a second prism that is further defined with a first outer dimension;

wherein the third arm is a hollow first prism that is further defined with a second inner dimension;

wherein the fourth arm is a second prism that is further defined with a second outer dimension;

wherein the first arm and the second arm are geometrically similar;

wherein the third arm and the fourth arm are geometrically similar;

wherein the first outer dimension of the second arm is less than the first inner dimension of the first arm such that the second arm inserts into the first arm in a telescopic manner;

wherein the second outer dimension of the fourth arm is less than the second inner dimension of the third arm such that the fourth arm inserts into the third arm in a telescopic manner;

wherein the position of the second arm relative to the first arm is held in position using the first detent;

wherein the position of the fourth arm relative to the third arm is held in position using the second detent.

16. The organizing apparatus according to claim 15 wherein the span of the length of the combination of the first arm and the second arm is selected such that the first telescopic anchor will fit tightly between the left vertical surface and the right vertical surface;

wherein the span of the length of the combination of the third arm and the fourth arm is selected such that the second telescopic anchor will fit tightly between the left vertical surface and the right vertical surface.

17. The organizing apparatus according to claim 16 wherein the first arm is further defined with a first end and a second end;

wherein the second arm is further defined with a third end and a fourth end;

wherein the third arm is further defined with a fifth end and a sixth end;

wherein the fourth arm is further defined with a seventh end and an eighth end;

wherein the first arm further comprises a first pad;

wherein the first pad forms a non-skid surface that attaches to the first end of the first arm;

wherein the second arm further comprises a second pad;

wherein the second pad forms a non-skid surface that attaches to the fourth end of the second arm;

wherein the third arm further comprises a third pad;

wherein the third pad forms a non-skid surface that attaches to the fifth end of the third arm;

wherein the fourth arm further comprises a fourth pad;

wherein the fourth pad forms a non-skid surface that attaches to the eighth end of the fourth arm;

wherein each of the plurality of baskets is an openwork structure;

wherein the plurality of shelves is an openwork structure.

* * * * *